US005090193A

United States Patent [19]

Schwarz et al.

[11] Patent Number: 5,090,193

[45] Date of Patent: * Feb. 25, 1992

[54] ACTIVE CLEARANCE CONTROL WITH CRUISE MODE

[75] Inventors: Fred M. Schwarz; Clifton J. Crawley, Jr., both of Glastonbury; Anthony F. Rauseo, Middletown; Ken R. Lagueux, Berlin, all of Conn.

[73] Assignee: United Technologies Corporation, Hartford, Conn.

[ * ] Notice: The portion of the term of this patent subsequent to Feb. 25, 2000 has been disclaimed.

[21] Appl. No.: 370,434

[22] Filed: Jun. 23, 1989

[51] Int. Cl.[5] ..... F02C 7/18

[52] U.S. Cl. ..... 60/39.02; 60/39.75

[58] Field of Search ..... 60/39.02, 39.29, 39.75; 415/116, 117, 178

[56] References Cited

U.S. PATENT DOCUMENTS

| | | | |
|---|---|---|---|
| 4,019,320 | 4/1977 | Redinger, Jr. et al. . | |
| 4,304,093 | 12/1981 | Schulze | 60/39.29 |
| 4,329,114 | 5/1982 | Johnston et al. . | |
| 4,487,016 | 12/1984 | Schwarz et al. . | |
| 4,513,567 | 4/1985 | Deveau et al. | 60/39.02 |
| 4,576,547 | 3/1986 | Weiner et al. | 415/116 |
| 4,815,272 | 3/1989 | Laurello | 60/39.75 |
| 4,849,895 | 7/1989 | Kervistin | 60/39.75 |

*Primary Examiner*—Louis J. Casaregola

*Attorney, Agent, or Firm*—Troxell K. Snyder

[57] ABSTRACT

Flow of cooling air to a thermal clearance control system in a gas turbine engine is selectably scheduled between a normal power level versus clearance schedule and an increased efficiency cruising schedule. Selection of the cruising schedule is accompanied by a limitation on the rate of engine power increase during the period when the cruise schedule is selected.

2 Claims, 1 Drawing Sheet

ACTIVE CLEARANCE CONTROL WITH CRUISE MODE

CROSS REFERENCE TO RELATED APPLICATIONS

Reference is hereby made to copending, commonly assigned U. S. Patent Applications titled "Thermal Clearance Control Method for Gas Turbine Engines" by F. M. Schwarz and C. J. Crawley, Jr. U.S. Ser. No. 07/370,426 and "Clearance Control Method for Gas Turbine Engine" by F. M. Schwarz, K. R. Lagueux, C. J. Crawley, Jr. and A. J. Rauseo U.S. Ser. No. 07/392,398, filed on even dated herewith and which related subject matter.

FIELD OF THE INVENTION

The present invention pertains to a method of operating a gas turbine engine in conjunction with thermal active clearance control.

BACKGROUND

The control of the radial clearance between the tips of rotating blades and the surrounding annular shroud in axial flow gas turbine engines is one known technique for proving engine efficiency. By reducing the blade tip to shroud clearance, designers can reduce the quantity of turbine working fluid which bypasses the blades, thereby increasing engine power output for a given fuel or other engine input.

"Active clearance control" refers to those clearance control arrangements wherein a quantity of cooling air is employed by the clearance control system to regulate the temperature of certain engine structures and thereby control the blade tip to shroud clearance as a result of the thermal expansion or contraction of the cooled structure. It is a feature of such active clearance control systems that the cooling air flow may be switched or modulated responsive to various engine, aircraft, or environmental parameters for causing a reduction in blade tip to shroud clearance during those portions of the engine operating power range wherein such clearance control is most advantageous.

A reduction of blade tip to shroud clearance must be achieved judiciously. For example, overcooling the turbine case supporting the annular shroud such that the shroud interferes with the rotating blade tips results in premature wear of the shroud or abrasion and damage to the blade tips. It is therefore important that the reduction in blade tip to shroud clearance achieved by such clearance controls systems must be designed so as to avoid the occurrence of blade tip and shroud interference which may ultimately cause deterioration of overall engine operating efficiency, or worse, damage to the engine internal components.

DISCLOSURE OF THE INVENTION

It is therefore an object of the present invention to provide a method for operating a gas turbine engine having an active clearance control system which reduces blade tip to shroud clearance during part load operation.

According to the present invention, the method provides an alternate schedule of cooling air flow to the gas turbine engine for reducing blade tip to shroud radial clearance during periods in which the engine has entered a cruise mode of operation wherein its rate of increase of engine power is limited. The method according to the present invention further includes a set of criteria for determining the propriety of selecting the cruise mode of operation. The criteria may include environmental parameters, engine operating parameters, or operator input.

Selection of the cruise mode of operation causes the flow of clearance control cooling air to the engine to follow an alternate flow schedule which results in reduced blade tip to shroud radial clearance as compared to the normal flow schedule. This reduced clearance increases engine operating efficiency at the steady state, part load, engine cruise power level, however, such reduced clearance is insufficient to accommodate the usual transient differential thermal growth between the blade tips and shroud following a step change in power level.

It is therefore a feature of the present invention that the selection of cruise mode of operation and the corresponding alternate cooling flow schedule also includes a rate of change limitation on increasing engine power level. This limitation decreases the rate of response of the engine during cruise mode operation, thereby reducing the magnitude of the transient differential thermal growth during a change in engine power. Such reduced response, which may be undesirable over certain parts of the engine operating range, is acceptable during the cruise mode of operation as selected by the method according to the present invention.

The advantage of this method is the achievement of operating efficiency during certain periods of engine operation without compromising engine response over the remainder of the operating range. Both these and other objects and advantages of the method according to the present invention will be apparent to those skilled in the art upon review of the following specification and the appended claims and drawing figures.

DETAILED DESCRIPTION

Figure 1:
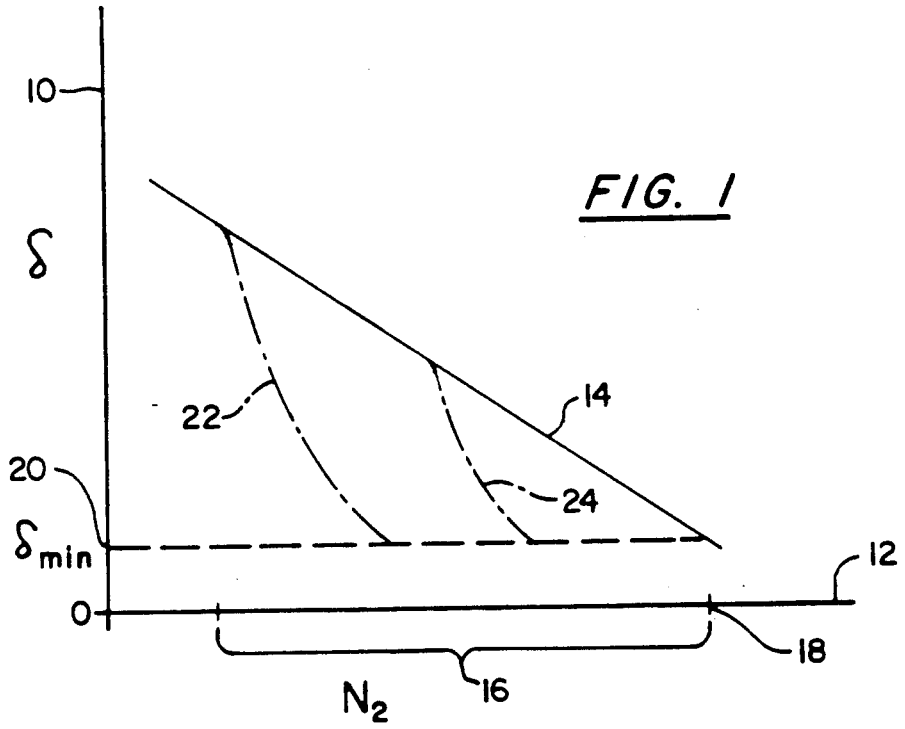
FIG. 1 is a graphic representation of the variation of blade tip to shroud clearance versus high rotor angular speed for steady state and transient operating conditions.

FIG. 1 shows a graphic representation of the radial clearance between the rotating blade tips of the high pressure turbine section of a gas turbine engine and the surrounding annular shroud. This clearance, represented on the vertical axis on the $\delta$, is controlled by thermally heating or cooling the surrounding turbine case by means of a controlled flow of cooling air which is exhausted directly on the case exterior. Increased cooling air flow cools the turbine case, causing it to contract circumferentially thereby reducing the shroud to blade tip radial clearance.

According to the control method disclosed in copending application "Clearance Control Method for Gas Turbine Engine", referenced above, blade tip to shroud clearance $\delta$ is optimally controlled responsive to engine level or, equivalently high rotor angular speed $N_2$.

FIG. 1 shows blade tip to shroud clearance $\delta$ on the vertical axis with high rotor speed $N_2$ on the horizontal axis 12. The sloping curve 14 represents the steady state blade tip to shroud clearance over a range 16 of normal power operation at maximum normal power level 18, it can be seen that the blade tip to shroud clearance $\delta$ is equivalent to the minimum required clearance, $\delta_{min}$ 20 and increases as engine power is reduced within the operating range 16. As disclosed in the above-mentioned application, the reason for the increased excess clearance at part power operation is represented by dashed curves 22, 24 showing the transient departure of blade tip to shroud clearance from the steady state curve 14 in response to a step increase in engine power from part load to the maximum normal power 18.

It has been observed that, while a gas turbine engine must be free to operate within the entire range 16 at all times, extended periods of engine operation within the normal power range 16 yet well below the maximum normal power 18, are known to occur regularly as the aircraft reaches cruising altitude and maintains such altitude, air speed, and engine power level setting for extended periods in route to a known destination.

The present invention improves upon the schedule shown in FIG. 1 by reducing the excess clearance between the rotating blade tip and surrounding shroud during periods of engine operation at extended, steady state cruising conditions. This is best illustrated by the alternate clearance curve 26 shown beneath the normal curve 14 repeated from FIG. 1. Curve 26 is achieved by increased cooling air flow at part load operation as compared to the normal clearance curve 14 which, without other modification to engine operation, could result in a serious under clearance or interference between the blade tips and shroud following a step in engine power.

This is illustrated by the hypothetical transient curve 28, representing the envelope of radial clearance decrease, which drops not only below the required minimum $\delta_{min}$ 20, but is also shown as falling below zero clearance, thereby indicating radial interference between the rotating blade tips and surrounding annular shroud. As noted in the above-referenced application, the excess clearance provided at part power operation by the clearance curve 14 and corresponding cooling air flow schedule is sized to accommodate this transient deviation as represented by curve 28.

As will be appreciated by those skilled in the art, the magnitude of the transient deviation from the steady state curves 14, 26 is a function of the rate of change of engine power in response to a step change in demand. Hence, by reducing the response rate of the engine to a demanded increase in engine power, the magnitude of the departure from the steady state clearance curve 14, 26 may be reduced at the expense of engine response time. The present invention is based on the recognition that while unacceptable for the totality of the expected engine operating range, the limitation on the rate of power increase in response to a step change in demand may be acceptable within certain defined periods of aircraft and engine operation.

Figure 2:
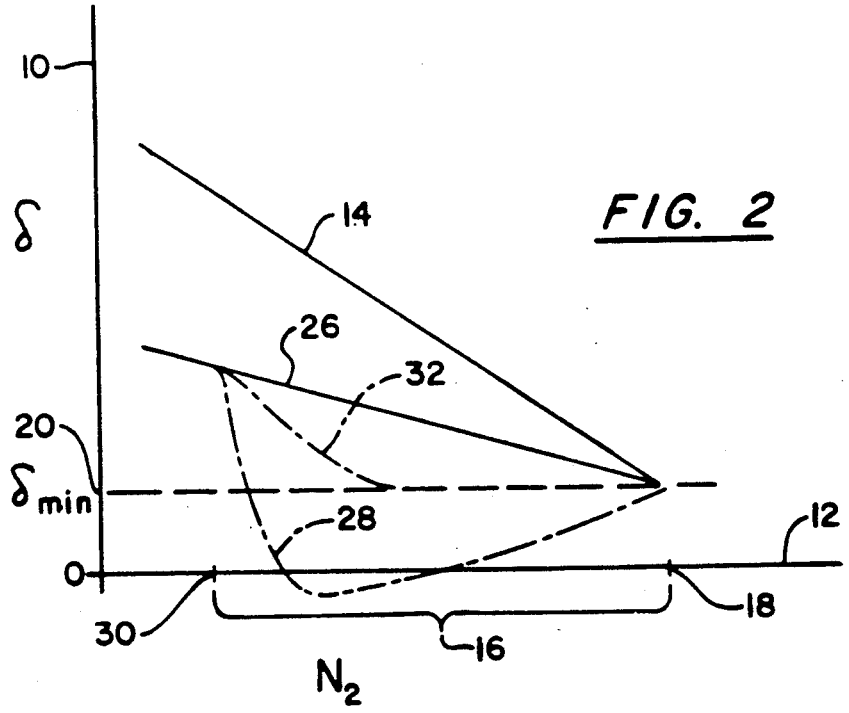
FIG. 2 additionally shows the variation of blade tip to shroud clearance versus high rotor speed at steady state for the alternative flow schedule according to the present invention, including certain transient responses.

As an example of such periods wherein the cruise mode of operation according to the present invention may be used, the engine operating range of a passenger aircraft will be considered. During takeoff and climb to altitude, the cooling air flow through the active clearance control portion of the engine or engines on the aircraft may be regulated to achieve the normal operating curve 14 as shown in FIG. 1. This curve permits timely response of the engine power to changes in demand as may be required to execute climb out, turning, etc. Once the aircraft has reached the desired cruising altitude, the method according to the present invention provides for the selecting of the "cruise mode" wherein the alternate cooling air flow schedule is implemented, resulting in the clearance response 26 as shown in FIG. 2. Upon entering the cruise mode of operation, a limitation is place on the rate of change of engine power in response to the pilot demand, thus resulting in the reduced transient deviation as represented by curve 32 in FIG. 2.

By reducing the need for excess clearance as a result of the response limitation on engine power changes, the method according to the present invention permits the reduction in excess clearance between the blade tips and shroud thereby improving overall engine operating efficiency by reducing the amount of working fluid bypassing the blade rotor stages within the engine. As will be appreciated by those skilled in the art, the slower engine response time during such periods of operation is acceptable to operators and pilots as the very nature of cruising operation implies steady state, relatively unchanging engine power output. Actions by the aircraft pilot to change altitude, accommodate reduced fuel rate, or counteract headwinds, etc., and which require changes in engine power level can readily be accommodated in the cruise mode although response time has been somewhat increased.

The cruise mode of operation is deselected according to the method of the present invention as the aircraft nears its final destination wherein it descends and begins landing maneuvers. Cooling air flow is again controlled responsive to the normal flow schedule resulting in the larger excess clearance at part load power shown by the curve 14.

Selection of the reduced clearance, increased response time cruise mode of operation according to the present invention may be achieved by a variety of selective processes, including by not limited to pilot control, altitude sensing, interaction with aircraft course and position control system, etc. The overall criteria for selecting cruise mode is that the aircraft and engines should be reasonably expected to be entering a future period of extended, steady state operation wherein no immediate, quick response increase in engine power should be expected. Likewise, the deselection of cruise mode may follow a step change in engine power level demand outside of a preselected range or percentage thus indicating that the engine or aircraft has reached the end of the extended period of steady state operation.

We claim:

1. A method for operating an aircraft gas turbine engine having an active blade clearance control system, including means for delivering a scheduled flow of cooling air to the engine, the flow rate of cooling air scheduled responsive to an expected engine transient response to a step change in engine power level, comprising the steps of:

selecting a cruising subrange of engine operating power levels within the permitted range of engine operating power levels, selectively providing an alternative cruise schedule of cooling air flow rates at corresponding current engine power levels within the cruising subrange, and limiting the magnitude of any step change in engine power level during operation of the engine within the cruising subrange.

2. The method as recited in claim 1 wherein the step of selectively providing the cruise schedule includes the steps of:

monitoring at least one engine or aircraft operating parameter selected from a plurality of operating parameters including, engine high pressure rotor angular speed, engine low pressure rotor angular speed, engine power demand setting, ambient air temperature, ambient air pressure, altitude, engine pressure ratio, aircraft operator input, and the elapsed time since the last engine power level demand change; and selecting and deselecting the alternate cruise schedule of cooling air flow responsive to the monitored engine or aircraft operating parameters.

* * * * *

UNITED STATES PATENT AND TRADEMARK OFFICE

CERTIFICATE OF CORRECTION

PATENT NO. : 5,090,193

DATED : February 25, 1992

INVENTOR(S) : Fred M. Schwarz and Clifton J. Crawley

It is certified that error appears in the above-identified patent and that said Letters Patent is hereby corrected as shown below:

On the title page;

"Anthony F. Rauseo and Ken R. Lagueux" should not be included as inventors

Title page

IN THE NOTICE

The date should read -- Feb. 25, 2008 -- instead of "Feb. 25, 2000"

IN THE CLAIMS

Claim 1, Column 4, Line 53, -- tip -- should be inserted after "blade"

IN THE CLAIMS

Claim 1, Column 4, Line 62, "alternative" should be -- alternate --

Signed and Sealed this

First Day of June, 1993

*Attest:*

Michael K. Kirk

MICHAEL K. KIRK

*Attesting Officer*

*Acting Commissioner of Patents and Trademarks*